United States Patent [19]

Ettenreich et al.

[11] 3,933,534

[45] *Jan. 20, 1976

[54] CONTINUOUS HEAT TREATING PROCESS FOR LOW CARBON STRUCTURAL STEELS IN BAR FORM

[75] Inventors: Ludwig Ettenreich, Vienna, Austria; Otto Reimann, Dusseldorf-Oberkassel; Klaus Greulich, Erkrath, uber Dusseldorf, both of Germany

[73] Assignee: Bau-Stahlgewebe GmbH, Dusseldorf-Oberkassel, Germany

[ * ] Notice: The portion of the term of this patent subsequent to Mar. 5, 1991, has been disclaimed.

[22] Filed: May 11, 1972

[21] Appl. No.: 252,690

[30] Foreign Application Priority Data

May 13, 1971 Germany ..... 2123687

[52] U.S. Cl. ..... 148/12 B; 148/12 F; 148/12.4; 148/39; 148/134; 148/144; 148/145; 148/150; 148/154

[51] Int. Cl.[2] ..... C21D 1/18

[58] Field of Search ..... 148/143, 144, 145, 150, 148/152, 154, 12.4, 12, 134, 39, 12 R, 12 B, 148/12 F

[56] References Cited

UNITED STATES PATENTS

| | | | |
|---|---|---|---|
| 1,946,876 | 2/1934 | Northrup | 148/150 |
| 3,756,870 | 9/1973 | Kasper et al. | 148/150 |

*Primary Examiner*—R. Dean
*Attorney, Agent, or Firm*—Haseltine, Lake & Waters

[57] ABSTRACT

An improvement in a process for preparing a structural steel having a maximum carbon content of 0.26 weight percent, the balance comprising iron, wherein the steel is continuously heated with the use of rapid heating, followed by quenching, the improvement comprising heating the steel only in its shell to a temperature between $A_{cl}$ and 1,300°C such that the core heats up at an average rate of at least 100°C/sec. up to a temperature between incipient pearlite transformation ($A_{cl}$) and 900°C, and thereafter, but prior to the attainment of equilibrium with respect to the carbon content, quenching said steel.

20 Claims, 2 Drawing Figures

CONTINUOUS HEAT TREATING PROCESS FOR LOW CARBON STRUCTURAL STEELS IN BAR FORM

Figure 1:
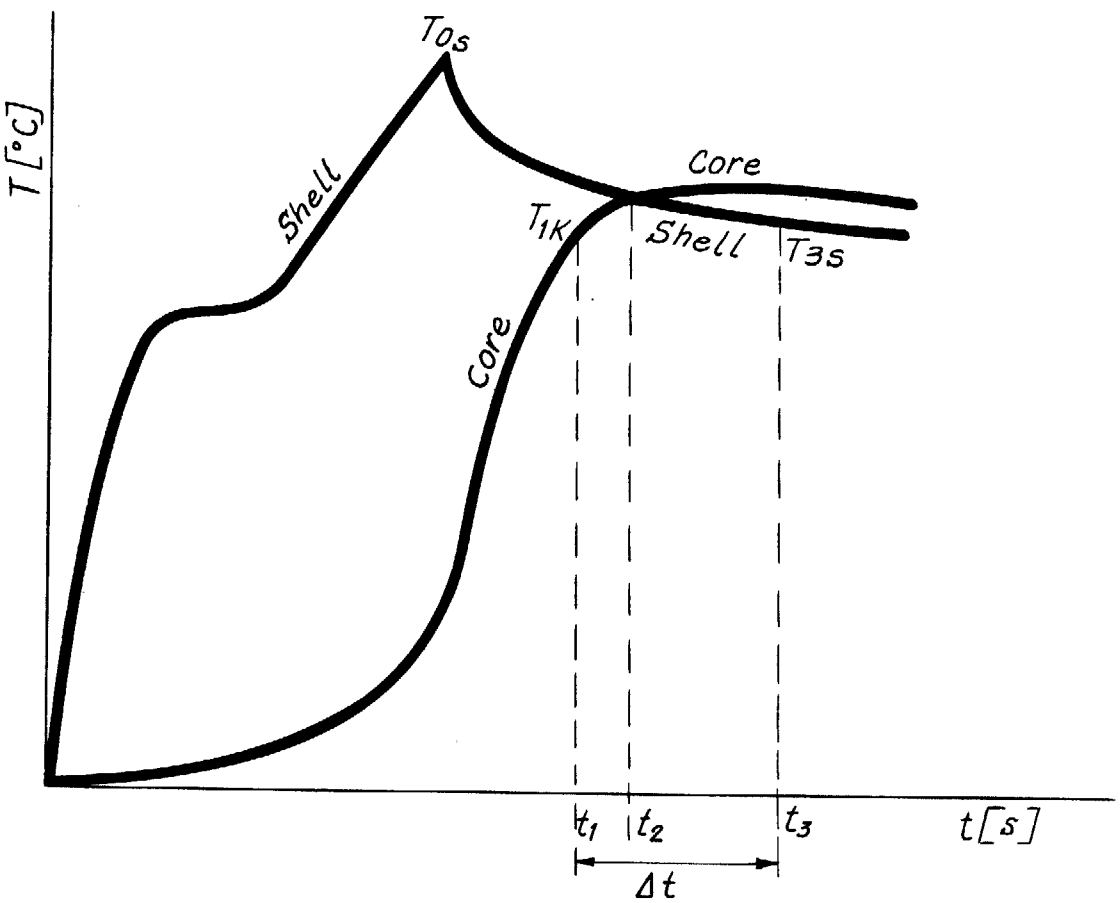

The invention relates to a continuous heat treating process for low-carbon structural steels in bar form (maximum 0.26 C, balance iron and the accompanying elements commonly used with structural steels in general) for the improvement of the mechanical characteristics thereof (strength, elongation, or ratio of strength to elongation) using a high-speed heating process followed by quenching.

The induction process is especially suitable for the high-speed heating. The bases for this process pertain to the state of the art and are described in conjunction with examples of its application in "Grundlagen der induktiven Erwarmung" (Das Industrieblatt, Stuttgart, Apr. 1960, pp. 204–210). The best known application is the induction hardening of surfaces. In this process, high-carbon (hardenable, or hardenable and temperable) steels are briefly skin-heated and then quenched. As it is furthermore apparent from the literature, however, it is also possible by means of induction to achieve a very uniform heating all through a work-piece (heating for forging).

We shall now consider known processes which use rapid heating by means of induction.

German Pat. No. 879,111 discloses a method for electroinductively tempering a steel which has preferably been hardened from the hot-rolling heat.

An annealing treatment is disclosed in Austrian Pat. No. 173,474 in which a steel wire is completely austenitized by the heating, quenched, and then tempered in a special manner.

The applications mentioned above have had to do with high-carbon, non-weldable steels, especially annealing steels.

It is also in the state of the art, however, according to Austrian Pat. No. 281,089, to treat steels which are actually non-hardening (0.10 to 0.23% C) by means of gas-oxygen burners or electrical heating devices followed by a water spray in a feed-through process. This process results in an appreciable increase in the strength characteristics. Differences in hardness between the surface and the core are compensated in the subsequent tempering process, depending on the required strength, so that one might correctly consider it to be a full annealing process.

In laboratory experiments a heat treating process has also been performed on a low-carbon steel wire, the steel wire being then subjected to further forming operations in the cold state. By this process steel wires from 8 down to 2 mm in diameter have been inductively heated to high temperatures and then rapidly quenched from the austenite region by means of water, whereupon martensite was formed. As the quenching temperature increased, the tensile strength was found to increase while the elongation characteristics were not as good. Evidently these experiments have not led to an industrial process.

In the heat treatment of concrete reinforcing steel, the use of rapid heating followed by quenching has additionally been published in the following connection:

According to Evangulova E. P. and Golovin G. F. ("Oberflachenhartung von Betonstahl"; Taschenbuch fuer Mitarbeiter des Allunionsforschungs-Institutes fuer Hochfrequenztechnik, "Maschinebau," Moscow-Leningrad (1965), Part 6, pp. 92–100), a reinforcing bar of 32 mm diameter (0.26% C, 0.55% Mn), in the rolled condition, is rapidly skin heated to 970 to 980°C, then quenched, and then re-annealed at a temperature of 500 to 530°C. Measurements have shown that the core heated up to a temperature of 600° to 650°C. It is further stated that the bars cannot be used after the surface hardening unless they are re-annealed, because the elongation is too low.

Lastly, there is German "Auslegeschrift" 1,246,002 according to which a concrete reinforcing steel in the rolled condition may be subjected to an inductive heat treatment in cross-sectional portions near the surface to a temperature between 600° and 1,050°C This is followed by quenching and then cold working by twisting, stretching or the like.

In the two last-named publications, the principle of rapid heating followed by quenching represents a part of the essential procedure that must be followed.

The invention addressed itself to the problem of devising a method of heat treating low-carbon steels which would bring about an increase of strength along with good elongation characteristics. The preferred minimum values which are to be achieved by the heat treating process of the invention will be stated hereinafter, because only a steel having very good or at least satisfactory elongation values can be used if increasingly stringent requirements are to be met, since only such as steel is sufficiently reliable.

The problem is solved by the invention in that only the "skin" of the steel is heated to a temperature between $Ac_1$ and 1300°C in such a manner that the core, on the average, heats up at a rate of at least 100°C/sec, preferably 300°C/sec, to a temperature between incipient pearlite transformation ($Ac_1$) and 900°C, quenching being performed before equilibrium is reached in regard to the carbon content. The clearest idea of the temperature range selected for the quenching can be obtained by studying FIG. 1, which will be described later.

Preferably the core is heated at about 700°C/sec in the center.

It is especially advantageous to quench at the moment in which the core temperature and the skin temperature are equal ($t = t_2$ in FIG. 1).

Preferably, the total amount of time from the crossing of the $Ac_1$ point to the beginning of the quenching will be no more than 5 seconds.

Special advantages are achieved when the elapsed time between the crossing of the pearlite line in the core and the commencement of quenching on the surface amounts to a maximum of 1.5 seconds, and especially less than 1 second. Good results can also be achieved if it is even less than 0.5 second. The first crossing of the pearlite line refers to the first transformation of any part of the structure in the core, that is, not the entire structure. The time at which this occurs can easily be determined by means of microscopic studies.

Preferably the quenching is performed by projecting or spraying water on the steel at a pressure of at least 2 atmospheres.

Advantages are achieved, especially economic advantages, if the steel is preheated, prior to the heat treatment, to temperatures of a maximum below $Ac_1$. It is desirable that this preheating be limited to the upper crystal recovery range. This upper crystal recovery range is to amount to a maximum of about 550°C for the low-carbon steels which we are concerned with here. No structure changes (recrystallization) are to take place in this range. It is especially advantageous to preheat the steel continuously by induction, with great penetration depth. By great penetration depth is meant that, in the case of small bar dimensions, such as 6 mm diameter, more than 90% of the bar cross section is primarily reheated, while the remainder of the bar cross section is preheated by the conduction of heat to the core. In the case of commonly used sizes, such as 12 to 16 mm diameter, great depth of penetration is considered to mean that at least 60% of the bar cross section is primarily preheated. In practice it is desirable to install a medium frequency induction neater ahead of the high frequency induction system serving for the rapid heating.

It is especially advantageous, in the process of the invention for improving the strength characteristics ($\sigma_B$, $\sigma_S$) while nevertheless providing very good elongation characteristics, to produce in the core a temperature of at least $Ac_1$ at a skin surface temperature of up to 1,000°C (see FIG. 1), the quenching reducing the temperature from that point at a cooling rate (average) of at least 800°C per second. The average cooling speed which we have given relates to the period of time within which the surface is quenched down to a temperature below, say, 150°C. At the beginning of the quench the figure is appreciably higher. At the beginning of the quench the cooling rates are around 1200°1,200°to 1,700°C per second.

Preferably, within the temperature equalization range for the time $t = t_2$ (the time at which the core temperature and the skin surface temperature are equal), a temperature of 750° to 850°C is brought about, the quenching being performed from that temperature.

Water is the preferred quenching agent and is applied to the bar surface at a pressure of up to 12 atmospheres. Especially preferred is a water flow of between 6 and 30 liters per kilogram of steel. The term "kilogram of steel" corresponds to the quantity of bar steel fed into the quenching zone. A water pressure between 3 and 7 atmospheres is especially preferred. The moment in which the skin surface temperature drops below 650°C ($t = t_3$ in FIG. 1) may be considered as the latest moment at which the quenching is to be performed.

It is advantageous to perform a slight cold working operation—equivalent to a straightening operation—after the quench, for certain applications.

For other purposes, especially the improvement of the elastic limit (as well as the creep limit) it is advantageous after the quenching to perform a heat treatment at temperatures between 100° and 380°C, preferably around 340°C, particularly within holding times in which the elastic limit increases sharply (e.g., a holding time of 20 to 30 minutes).

Preferably, the process of the invention is applied to a bar having a structure which consists of more than 50% of pre-eutectic ferrite, especially a bar material that has cooled down in air after the hot rolling process.

In regard to the alloy content, the process of the invention is applied preferably to unalloyed steels with a carbon content between 0.06 and 0.26%, especially 0.12 and 0.22%, with the customary contents of manganese and silicon. It is advantageous for the silicon content to amount to no more than 0.5% and the manganese content to no more than 0.8%.

Good results, however, are also produced with steels whose manganese content has been increased to as much as 1.8%.

The total alloying element content should not exceed 3%, the balance being iron and carbon plus accompanying elements (impurities) in known amounts determined by manufacturing requirements.

The process of the invention is advantageously applied to bars of a diameter of 4 to 36 mm, especially 6 to 16 mm.

Particularly good results have been achieved in the application of the process to bar material that is 20 to 70%, especially 30 to 50%, cold-formed.

In the case of bar material made from concrete reinforcing steel, the steels treated in accordance with the invention are suitable especially for prestressed or nonstressed reinforcement, preferably for welded structural steel meshes.

It is to be noted that the above-described holding points A are changed by the alloying elements. For example, with regard to the $Ac_1$ point, for each percent of manganese content, this holding point is lowered by about 15°C.

The special advantage of the process of the invention is that very good elongation characteristics are retained in combination with a decided improvement of the strength characteristics.

First a number of terms used in the specification and in the claims are to be defined:

"Bar form." By this is meant dimensions which always have substantially the same cross-sectional area perpendicularly to their long axis, but also and especially dimensions which also have a uniform surface contour.

"Skin" or "shell" of the bar. This means the stratum located outside of the core area of the bar.

As it will appear from the following paragraph, the thickness of the shell or skin, that is, especially the volume of the shell in relation to the volume of the core, is determined by the desired core temperature. Technically, the thickness of the desired shell is determined in the induction heating process by the frequency. The lower the frequency is, the greater will be the thickness of the shell. The amount of heat that is transferred is regulated by the size of the coil and the power density. The higher the power density is made, the faster and hotter the shell is heated. The desired temperature is thus produced in the shell by properly selecting the frequency and adjusting the rate of feed of the bar to the coil size and power density (time of stay of the bar in the induction zone. The adjustment of the required power density to the shell volume to core volume ratio is performed on the basis of the temperature desired within the temperature range in which the quenching is to be performed (temperature equalization range).

For easier comprehension, see FIG. 1 in this regard. In FIG. 1 the time-temperature curve of an induction heating system not followed by quenching with water is represented diagrammatically (cooling in the air by radiation). The diagrammatic representation corresponds approximately to the temperature distribution in a wire 8 mm in diameter which has been heated primarily, on the basis of a certain frequency, within a shell or skin approximately 0.8 mm thick. As FIG. 1 indicates, even during the time of stay inside of the induction coil, a slight amount of heat flow toward the core takes place. In the example shown, most of the heat flow from the hot shell to the relatively cold core takes place after the wire leaves the induction coil ($T_{OS}$ in FIG. 1). This equalization over the bar cross section with the passage of time comes is what is meant by the temperature equalization range. To achieve the effects in accordance with the invention, the water quench that follows must be performed within this interval of time or temperature equalization range.

The diagram represented in FIG. 1 shows the temperature distribution simulated by computer, without the subsequent water quench, only the earliest and latest times within which the water quenching is to be performed being indicated.

To comply with the lower time limit (abscissa $t_1$) it is necessary that the core temperature be above $T_{1K}$. To comply with the upper time limit (abscissa $t_3$), the shell surface temperature may not drop below $T_{3S}$. The temperatures given in the claims and in the examples give the marginal conditions (temperatures of the shell surface and of the core).

It will be apparent that, in view of the extraordinarily rapid heating and cooling, the differential temperatures, i.e., the temperatures to be measured between shell and core, may differ from these; for example, they may be higher at the moment when $t = t_2$.

The process of the invention, however, represents a clear teaching in stating the marginal conditions. The quenching is to be performed within the following lapse of time: at the bottom time limit $t = t_1$ the core temperature ($t_1k$) is to be at the incipient pearlite transformation point ($Ac_1$), and this time is defined as the time at which any part of the core which has undergone the transformation ($\alpha$—$\gamma$—$\alpha$) can be detected. For the upper time limit $t = t_3$ it has been stated that the quenching is performed within the prescribed temperature ranage ($Ac_1$ to 900°C) prior to the establishment of equilibrium in regard to the carbon content. As it will be explained later on, the conditions are to be made such that, in the case of austenitization, no complete equalization of the diffusion of the carbon content must have taken place in the heated material.

In the following out the teachings given by the invention the technical man must also consider the following points:

Between the surface temperature and core temperature curves which can be simulated by means of computers and the actual temperature curves produced in practice a discrepancy might be brought about by failing to make allowance in the computer program for the radiation losses from the surface to the atmosphere after leaving the induction coil. On the other hand, the simplest thing for the technical man, in actual practice, is to determine the surface temperature by means of an optical pyrometer. It is for this reason that the temperatures given in the claims and in the specification refer to measured pyrometer temperatures (shell surface). With regard to the upper time limit in the temperature equalization range (abscissa $t_3$) it is to be noted that this temperature is not preferred in the practical performance of the process, but that this datum is intended only to define the upper time limit for the water quenching in the process of the invention. In accordance with the process of the invention it will be preferable to select as the quenching time within the given temperature equalization range the moment in which the rising core temperature and the falling surface temperature intersect ($t = t_2$ in FIG. 1).

The range of time within which this intersection occurs can easily be determined in practice by pyrometer readings, because after the equalization of the temperature towards the core has taken place the temperature drop that is measurable at the surface of the shell takes place much more slowly than before, because the loss of heat is then brought about only by radiation to the atmosphere.

A detailed explanation will now be given, with the aid of examples.

EXAMPLES

In accordance with the teaching of the invention, the shell is heated to a temperature between $Ac_1$ and 1,300°C in such a manner that the core heats up at an average of at least 100°C/sec, preferably at least 300°C/sec, to a temperature between $Ac_1$ and 900°C, the quenching being performed before an equilibrium is reached in regard to the carbon content.

As it will be apparent from the following examples, a core temperature of 750°C (and 850°C, respectively) is preferred. From the preferred warming speed averaging 300°C/sec and the core temperature of 750°C it is calculated that 2.5 seconds (2.8) elapse between entrance into the coil and the time of the water quench. Setting out from the above-given marginal conditions and a bar diameter of 8 mm, it can be calculated that, for a time of stay of 1.3 seconds in the coil, a frequency of 485 kHz is required and a power density within the area of 800 to 1,200 watts per square centimeter.

If use is made of the preferred method of performing the heat treatment of the invention on a preheated bar, the warm up time is shorter in accordance with the initial temperature to which the bar has been preheated. Thus, if the bar is preheated to 550°C and a core temperature of 750°C is desired, only 0.66 sec will elapse from the entrance of the material into the high-frequency coil to the start of the quench, at a warm-up rate of about 300°C/sec. To maintain this warm-up rate it is necessary to heat the shell in the high-frequency coil to a corresponding high temperature, without reaching the time when $t = t_2$ in the temperature equalization range after this brief period of time.

In the practical performance of the process, this time (temperature) can be achieved in a variety of ways for a particular bar diameter by the coordination of the feed speed, the frequency and the power density within the limits prescribed in the claims.

For example, a very thin shell (in relation to the core volume) can be heated to a very high temperature in the coil (far above $Ac_3$) or even a very thick shell can be heated to a temperature not very far (50° to 200°C) from the temperature prevailing at the time $t_2$ (see FIG. 1).

Hereinbelow are given a number of embodiments which are reflected in detail in Tables 1, 2 and 3.

In the tables, for a specified bar section and the stated analysis, the changes are listed which are brought about in the mechanical characteristics of the material by the heat treatment of the invention.

The quenching was performed in all cases at the preferred time when $t = t_2$. The value designated as A is the mechanical value for the starting material (hot rolled state; room temperature).

The numeral I designates the range of a weaker cooling, action (3 to 5 atmospheres and II designates the area of a more intense chiling (7 to 12 atmospheres) (coolant water).

The following technical data apply to Table 1:

| | |
|---|---|
| Starting condition A | hot-rolled, room temperature |
| Analysis: 0.16% C, 0.9% Si, 0.52% Mn | Balance iron and the usual accompanying elements |
| Diameter | 6 mm |
| Time of stay in the coil | 1 sec |
| Frequency | 485 kHz |
| Total time up to start of the quench | 2 sec |
| Quench intensity (Water) I | 4 atmospheres gauge, 8 liters per kg of steel |
| (Water) II | 8 atmospheres gauge, 26 liters per kg of steel |
| Time of stay in the quenching area | 0.5 sec. |

As Table 1 shows, at the equalization temperatures ($t = t_2$) of 750°, 800° and 850°C a great increase in the strength characteristics is achieved while the elongation characteristics are still very good; for example, at an equalization temperature of 800°C, the heat treatment of the invention results in a steel with a tensile strength of 75.5 kg/mm² and an elongation ($\delta_{10}$) of 12.1%. Appreciably better tensile strength values are achieved at a slightly higher carbon content and manganese content, as shown, for example, in Table 3 in the case of rolled bars 12 mm in diameter. There, at an equalization temperature of 800 °C and quenching rate II a tensile strength of °93.0 kg/mm² is achieved at an elongation ($\delta_{10}$) of 11%. This steel had a Vicker's hardness of 359 at the edge and a Vicker's hardness of 300 kg/mm² in the core. These Vicker's hardnesses are averages and are of only limited significance, because especially at very low austenitization temperatures and very short austenitization times a very heterogeneous structure is formed both as regards the overall cross section and as regards the individual crystallites.

As shown in Table 1, when there is a great increase in the tensile strength there is also an increase in the Vicker's hardness at the periphery of the steel bar and in the core of the steel bar. The Vicker's hardness values given are averages of 8 individual measurements.

The individual values for a mean value can fluctuate to such an extent that the maximum value is more than twice the minimum value.

With the process according to the invention preferably the following minimum material characteristics can be obtained:

| | | |
|---|---|---|
| Tensile strength $\sigma_B$ | = 70 kg/mm² | and higher, |
| at an elongation $\delta_{10}$ | = 11.0 % | and higher, |
| and a proportional elastic limit (Gleichmassdehnung) $\delta_g$ of | 5.0 % | and higher. |

For further distinction of the process according to the invention, the following results are set forth, which can be obtained by employing the preferred process requirements:

According to the preferred teaching, for the period $t = t_2$ according to FIG. 1 a temperature of 750 to 850°C is brought about. In detail, the following values are particularly important:

| Bar | Diameter | % C | % Mn | % Si |
|---|---|---|---|---|
| | Starting condition: | | | |
| 1 | 6 mm | 0.10 | 0.61 | 0.16 |
| 2 | 8 mm | 0.21 | 0.70 | 0.17 |

Material characteristics

-continued

| | Starting condition (36% cold-rolled) | Starting condition: Temperature at $t=t_2$ according to FIG. 1 | | |
|---|---|---|---|---|
| | | 750°C | 800°C | 850°C |
| $\sigma_B$ kg mm² | 64.0 | 80.0 | 85.0 | 113.0 |
| $\sigma_S$ kg mm² | 56.0 | 45.0 | 56.0 | 93.0 |
| Bar 1 | | | | |
| $\delta_{10}$ (%) | 10.2 | 9.5 | 10.0 | 8.2 |
| $\delta_g$ (%) | 3.0 | 6.7 | 5.2 | 4.1 |
| Bar 2 | | | | |
| $\sigma_B$ kg/mm² | 72.0 | 78.0 | 116.0 | 132.0 |
| $\sigma_S$ kg/mm² | 65.0 | 56.0 | 88.0 | 110.0 |
| $\delta_{10}$ (%) | 6.9 | 8.3 | 8.5 | 8.0 |
| $\delta_g$ (%) | 2.9 | 7.3 | 5.2 | 5.0 |

The high-speed heating process was above 300°C/s and the quenching time in the water shower was about 1 second. Within the framework of the above-named carbon contents, the following minimum values regarding the preferred process conditions are, therefore, particularly pointed out:

a tensile strength $\sigma_B$ of 90 kg/mm² and higher,
at an elastic limit of $\sigma_S$ = 70 kg/mm² and higher,
at an elongation (%)$\delta_{10}$ of 8% and higher,
and a proportional elastic limit ("Gleichmassdehnung")$\delta_g$ of 4% and higher.

The technical considerations set forth above lead to the general idea that processes are involved in which inhomogeneities of the crystal structure play an important role. In the hypoeutectoid steels which have been treated, a segregation takes place during the cooling, as we know, owing to the gamma-alpha two-phase region--along the line GOS in the iron-iron carbide equilibrium diagram. At the same time a pre-eutectoid ferrite precipitation takes place corresponding to the line GP. The remaining austenite becomes enriched with carbon to the pearlite point S and, when the pearlite line is reached, is transformed to pearlite.

With rapid heating in accordance with the invention, and the short time periods in the austenitization temperature range, a structural state is brought about in which a complete equalization of the carbon within the structure has not taken place.

Conditions may be so controlled that only the pearlite is transformed to austenite. Additionally, however, a transformation of ferrite to austenite can be permitted provided that this austenite remains poorer in carbon than an austenite corresponding to the state of equilibrium after complete equalization of the diffusion.

The quenching that is provided for by the invention transforms the more carbon rich portion of the structure to a component of greater strength, martensite usually occurring only in very small amounts.

This results in a differentiated structure which is probably also entitled to some credit for the desirable mechanical characteristics of the material, especially the outstanding combination of strength and elongation. It is from this general invention idea, therefore, that the teaching of the invention is arrived at.

A low-carbon structural steel of the abovedescribed kind, which has a crystallinely heterogeneous starting structure (alpha and pearlite), derived, for example, from the hot forming process by which it was made, is heated at a fast rate through the temperature region above the pearlite line. The rate of temperature rise and the final temperature are so selected that the pearlite and, in some cases, pre-eutectic ferrite are substantially transformed to austenite, but in order to prevent the establishment of equilibrium with regard to the carbon content, the material is quenched before this can take place.

Photomicrographs of the bars treated by the process of the invention show, in a typical structural form, ferrite centers which are relatively poor in carbon and which are surrounded by a broad network of troostite and, in the case of more rapid quenching rates, also by intermediate stage structures.

In the case of longer holding times (e.g., 10 seconds) and sufficiently high austenitization temperatures, however, these clearly defined boundaries between the ferrite center. and the surrounding network become less distinct.

The bar is to be virtually free of martensite over its entire cross section. Small amounts of martensite, however, are permitted in the peripheral area of the bar. By small amounts of martensite are meant martensite contents of less then 5%.

If the heat treatment in accordance with the invention is followed by the heat treatment at 340°C for 30 minutes, increases of the elastic limit of up to 50% are achieved, e.g., from 51 kg/mm² to 76 kg/mm² in the case of the steel in Table 3 (II 850°C). The yield point remains the same while the tensile strength diminishes slightly. The reduction at rupture is roughly similar to the elastic limit in its variation.

If there is a change in the carbon content within the stated limits, it becomes necessary, in order to sustain the optimum conditions, to make the core temperature higher within the claimed equalization range when the carbon content falls lower than in the examples, and vice-versa. The temperature in the rapidly heated shell is to be adapted to the desired higher or lower core temperature.

Figure 2:
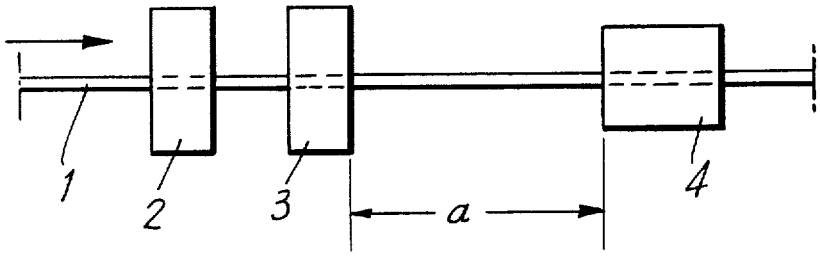

A description will now be given of FIG. 2, in which a preferred apparatus for the performance of the process of the invention is represented diagrammatically.

The numeral 1 identifies the bar, 2 the medium-frequency system serving for the preheating, 3 the high-frequency system used for the rapid heating, and 4 the water jet serving for the quenching. The preheating range can be limited by the stated minimum heating speed for the core.

This special advantages of the concrete reinforcing bars prepared in accordance with the invention lie in the fact that with bars of good elongation characteristics, due to the high proportion of equidimensional elongation structures having slack [= non-prestressed] reinforcement are given a much greater reliability, while the high-strength bars are especially suitable for prestressed reinforcement.

It is also important that, especially in the case of the low-carbon steels, the material characteristics achieved by the invention are not impaired by spot welding, for example.

The tests were performed at the welded crossing of a welded structural steel mesh. The test for the minimum shearing force (S = 0.3 × 0.2 × cross-sectional area of the starting bar) resulted in the required minimum values.

Mechanical characteristics that are in any way comparable with the subject of the invention can be achieved on the basis of the state of the art only in heat-treatable steels on the basis of appropriate alloying and an expensive heat-treating process, and it must be considered that these heat-treatable steels, suing to their higher carbon content, are not weldable.

TABLE 1

Starting condition A; hot-rolled; room temp.; 6 mm Diameter
Analysis 0.16% C; 0.09% Si; 0.52% Mn Balance iron and the customary contents

| T t = $t_2$ | $\sigma_S$ | $\sigma_B$ | $\delta_{10}$ | $\delta_g$ | Vicker's hardness HV edge | core |
|---|---|---|---|---|---|---|
| °C | kp mm² | kp mm² | % | % | | |
| A | 27.5 | 42.7 | 33.5 | 1.7 | 181 | 172 |
| I 700 | 44.5 | 48.1 | 26.3 | 5.0 | 195 | 170 |
| I 750 | 45.2 | 69.0 | 13.3 | 8.8 | 255 | 262 |
| II 800 | 51.5 | 75.5 | 12.1 | 6.2 | 234 | 256 |
| II 850 | 56.5 | 77.0 | 11.6 | 6.0 | 314 | 320 |

I slight cooling intensity (quenching rate)
II strong cooling intensity (quenching rate)

TABLE 2

Starting condition A; hot-rolled; room temp; 8 mm Diameter
Analysis:(0.16% C; 0.16% Si; 0.70% Mn;) balance iron and the customary contents

| °C t = $t_2$ | $\sigma_S$ kp/mm² | $\sigma_B$ kp/mm² | $\delta_{10}$ % | $\delta_g$ % |
|---|---|---|---|---|
| A | 34 | 48 | 27.7 | 15.0 |
| I 750 | 42 | 70 | 15.2 | 10.0 |
| I 800 | 53.5 | 77 | 13 | 7.0 |
| I 850 | 69 | 87 | 10 | 5.4 |

TABLE 3

Starting condition A; hot-rolled; room temp; 12 mm diameter
Analysis: 0.17% C; 16% Si; 0.63% Mn; Balance iron and the customary contents

| T t = $t_2$ | $\sigma_S$ | $\sigma_B$ | $\delta_{10}$ | $\delta_g$ |
|---|---|---|---|---|
| °C | kp mm² | kp mm² | % | % |
| A | 25.2 | 44.0 | 32.6 | 22.0 |
| I 700 | 40.5 | 57.5 | 20.0 | 13.8 |
| I 750 | 39.2 | 58.2 | 19.0 | 15.0 |
| I 800 | 49.5 | 71.5 | 14.8 | 9.5 |
| II 800 | 51.5 | 93.0 | 11.0 | 5.0 |
| II 850 | 78.0 | 103.0 | 9.4 | 4.5 |

What is claimed is:

1. In a process for preparing a structural steel in which the steel is rapidly heated and thereafter quenched, said steel having a maximum carbon content of 0.26 weight percent, the balance comprising iron, the improvement which comprises heating said steel only in its shell to a temperature between its incipient pearlite transformation and 1300°C such that its core heats up at an average rate of at least 100°C/sec. to a temperature between the incipient pearlite transformation and 900°C and commencing quenching in less than 5 seconds from passing the incipient pearlite transformation point, and performing the quenching operation prior to the attainment of equilibrium with respect to the carbon content and effecting said quenching prior to reduction of the shell surface temperature to a value below 650°C, so that the more carbon rich portions are transformed to a substantially martensite free structure throughout the transverse cross-section thereof.

2. A process according to claim 1 wherein said steel is heated such that its core heats up at an average rate of at least 300°C/sec.

3. A process according to claim 2 wherein the quenching is initiated at the moment in which the rising core temperature is equal to the falling shell surface temperature.

4. A process according to claim 2 wherein the time of stay from the first passing of the incipient pearlite transformation point in the core to the beginning of the quenching amounts to no more than 1.5 seconds.

5. A process according to claim 1 wherein the quenching is performed by projecting or spraying water onto said steel, said water under a pressure of at least 2 atmospheres.

6. A process according to claim 1 wherein a temperature is produced in the core of said steel of at least the incipient pearlite transformation point at a shell surface temperature of up to 1,000°C and thereafter the steel is quenched at an average cooling rate of at least 800°C/sec.

7. A process according to claim 1 wherein the steel is straightened after quenching.

8. A process according to claim 1 wherein after quenching the steel is subjected to a heat treatment performed at temperatures between 100° and 380° C for a period of time sufficient to increase the elastic limit of the steel.

9. A process according to claim 8 wherein the temperature is about 340° C and the steel is maintained at such temperature for a period of time between 20 and 30 minutes.

10. A process according to claim 1 wherein the steel is in the form of a bar consisting of at least 50% pre-eutectic ferrite.

11. A process according to claim 1 wherein the steel is an unalloyed steel having a carbon content between 0.06 and 0.20 and containing quantities of manganese and silicon.

12. A process according to claim 11 wherein the unalloyed steel contains carbon in an amount between o.12 and o.22 weight percent.

13. A process according to claim 1 wherein the steel contains manganese present in an amount not greater than 1.8 weight percent.

14. A process according to claim 1 wherein the steel treated is in the form of a bar.

15. A process according to claim 14 wherein the bar has a diameter of between 4 and 36 millimeters.

16. A process according to claim 15 wherein the bar has a diameter between 6 and 16 millimeters.

17. A process according to claim 1 wherein the steel comprises between 20 and 70 % cold shaped bar material.

18. A process according to claim 17 wherein the amount of cold shaped bar material is between 30 and 50 %.

19. A process according to claim 1, wherein the more carbon rich portions are transformed into troostite.

20. A process as claimed in claim 3, wherein the temperature is selected between 750° and 850°C.

* * * * *